US006886684B2

(12) United States Patent
Hacikyan

(10) Patent No.: US 6,886,684 B2
(45) Date of Patent: May 3, 2005

(54) DIRECT CONTAINER FOR LIQUID MATERIALS

(75) Inventor: Michael Hacikyan, Buffalo, NY (US)

(73) Assignee: Technicor, Inc., Amherst, NY (US)

( * ) Notice: Subject to any disclaimer, the term of this patent is extended or adjusted under 35 U.S.C. 154(b) by 0 days.

(21) Appl. No.: 09/945,945

(22) Filed: Sep. 4, 2001

(65) Prior Publication Data

US 2002/0029982 A1 Mar. 14, 2002

Related U.S. Application Data

(63) Continuation-in-part of application No. 09/558,982, filed on Apr. 27, 2000, now Pat. No. 6,523,681.
(60) Provisional application No. 60/184,917, filed on Feb. 25, 2000.

(51) Int. Cl.[7] ..... B65D 81/26
(52) U.S. Cl. ..... 206/204; 206/524.4
(58) Field of Search ..... 206/204, 484, 206/484.2, 524.1, 524.2, 524.4, 524.5, 438, 363, 807, 205, 210, 213.1; 383/5, 36, 109, 113; 604/387, 317, 357; 428/337, 339, 340; 312/31.1

(56) References Cited

U.S. PATENT DOCUMENTS

| | | | | | |
|---|---|---|---|---|---|
| 1,408,757 | A | * | 3/1922 | Metzger | 206/204 |
| 2,283,867 | A | * | 5/1942 | Flosdorf et al. | 206/204 |
| 2,345,872 | A | | 8/1944 | Mitnick | |
| 3,441,023 | A | | 4/1969 | Rijssenbeek | |
| 3,621,994 | A | | 11/1971 | Brown | |
| 4,578,070 | A | | 3/1986 | Holtman | |
| 4,758,241 | A | | 7/1988 | Papajohn | |
| 4,776,463 | A | | 10/1988 | Press | |
| 4,853,266 | A | | 8/1989 | Cullen | |
| 4,873,193 | A | * | 10/1989 | Jensen et al. | 206/807 |
| 4,927,010 | A | * | 5/1990 | Kannankeril | 206/204 |
| 4,969,750 | A | | 11/1990 | Russo et al. | |
| 5,199,795 | A | * | 4/1993 | Russo et al. | 206/204 |
| 5,251,744 | A | | 10/1993 | Dziersk et al. | |
| 5,728,083 | A | | 3/1998 | Cohen et al. | |
| 5,833,058 | A | * | 11/1998 | Mabry | 206/204 |
| 5,934,773 | A | * | 8/1999 | Ferrell | 312/31.1 |
| 5,984,087 | A | | 11/1999 | Hacikyan | |
| 5,996,787 | A | | 12/1999 | Kobayashi | |

FOREIGN PATENT DOCUMENTS

| | | |
|---|---|---|
| DE | 3624410 A1 | 1/1988 |
| EP | 0526148 A1 | 3/1993 |
| EP | 1127804 A2 | 8/2001 |
| FR | 682144 | 9/1929 |
| FR | 1394113 | 2/1965 |
| WO | WO 00/06463 | 2/2000 |
| WO | WO 00158764 A2 | 8/2001 |

OTHER PUBLICATIONS

Communication—European Search Report; EP 01301743; 9 pages.

* cited by examiner

*Primary Examiner*—Luan K. Bui

(57) ABSTRACT

The present invention meets the above-described need by providing a container having at least one sidewall with an inner surface and an outer surface. A bottom wall connects to the side wall to form an enclosure. The inner surface and the bottom wall define some of the boundaries of a cavity that is formed within the container. A lid is designed to attach to a portion of sidewall where an opening is defined of the cavity. An absorbent material is disposed within the container. The absorbent material absorbs and retains, in some instances immobilizes, a liquid material such as a medical specimen that is deposited inside the container for shipping.

22 Claims, 2 Drawing Sheets

DIRECT CONTAINER FOR LIQUID MATERIALS

CLAIM OF PRIORITY

The present patent application is a continuation-in-part of U.S. patent application Ser. No. 09/558,982 filed Apr. 27, 2000, U.S. Pat. No. 6,523,681 which relies on the priority of U.S. Provisional Patent Application Ser. No. 60/184,917, filing date of Feb. 25, 2000.

FIELD OF INVENTION

The present invention relates generally to containers for shipping liquid materials, and specifically to a container for shipping medical specimens for testing.

BACKGROUND OF THE INVENTION

There is a need for shipping containers that are suitable for shipping medical specimens such as urine for pregnancy tests or the like. In remote areas where the distance to a medical offices or testing facilities is substantial, a device for shipping medical specimens such as urine would be desirable.

Absorbent materials have been used to control leaking materials as disclosed in U.S. Pat. No. 4,749,600 which discloses a packet for absorbing and immobilizing a liquid. The packet looks like a sugar packet (FIG. 3 of the '600 patent) by having an outer layer and inner contents. When the packet is to be used, it is inserted within an outer container, i.e., a Federal Express package.

U.S. Pat. No. 5,984,087, which is assigned to the assignee of the present invention and which is incorporated herein by reference, discloses a packaging container designed to transport an inner container containing a liquid. The packaging container has at least one sealing multi-layer comprising a first water soluble film and an absorbent material.

These patents are directed at providing leak protection for containers or vials shipped within outer containers. None of these patents disclose a container that is suitable for use as a primary container for shipping medical specimens.

SUMMARY OF THE INVENTION

The present invention meets the above-described need by providing a container having at least one sidewall with an inner surface and an outer surface. A bottom wall connects to the side wall to form an enclosure. The inner surface and the bottom wall define some of the boundaries of a cavity that is formed within the container. A lid is designed to attach to a portion of sidewall where an opening is defined of the cavity. An absorbent material is disposed within the container. The absorbent material absorbs and retains, in some instances immobilizes, a liquid material such as a medical specimen that is deposited inside the container for shipping.

BRIEF DESCRIPTION OF THE DRAWINGS

The invention is illustrated in the drawings in which like reference characters designate the same or similar parts throughout the figures of which.

DETAILED DESCRIPTION

Figure 1:
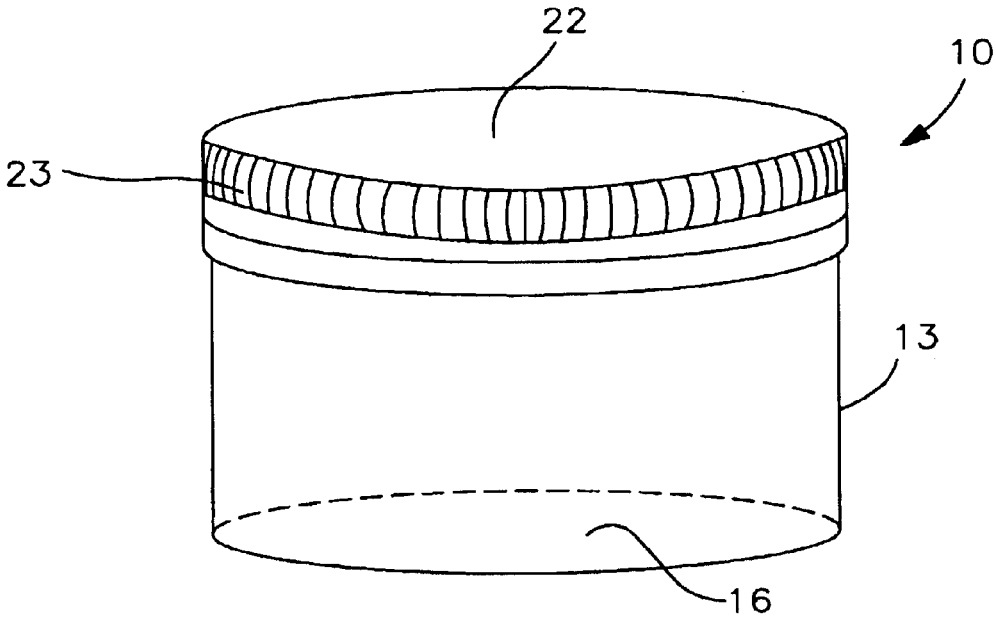
FIG. 1 is a perspective view of the container of the present invention.
Figure 3:
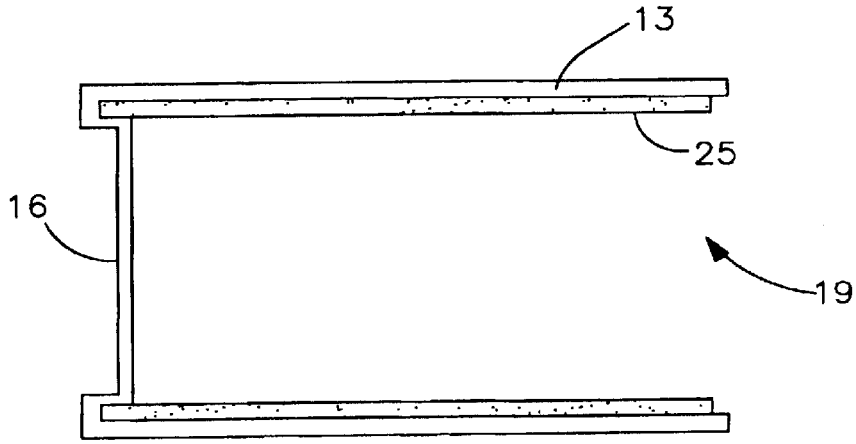
FIG. 3 is a cut-away side view of the container.

In FIG. 1 a container 10 having a side wall 13, a lid 22, and a bottom wall 16 that defines the boundaries of a cavity 8 is shown. The side wall 13, as shown, is cylindrical and defines the side boundaries of the cavity 8. The bottom wall 16 is planar and defines the bottom boundary of the cavity 8. Other shapes would also be suitable for these elements, for example, wall 13 can have a polygon shape and wall 16 corresponds to the shape of wall 13 except it can be planar as shown in FIG. 1, indented into the cavity as shown in FIG. 3, or protrude beyond the wall 13. Also, the side wall 13 and bottom wall 16 may be constructed of any suitable material such as cardboard, wood, plastic, or metal.

The bottom wall 16 closes off one end of the container 10. At the opposite end, an opening 19 is defined at the end of the side wall 13. A lid 22 attaches to the open end of the container 13 and is designed to define the top boundary of the cavity 8.

Figure 2:
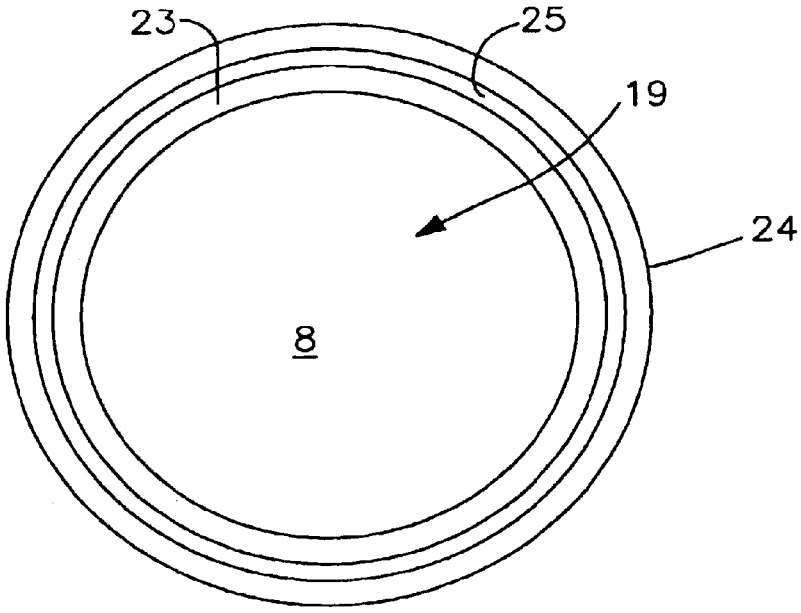
FIG. 2 is a top plan view of the container of the present invention with the lid removed.

The lid 22 may be provided with a ribbed surface 23 for easier gripping. The lid 22 may also be provided with a set of internal threads capable of engaging with a set of external threads 24, as shown in FIG. 2, disposed on the container 13. Alternatively, the lid 22 could attach to a set of internal threads 25 or internal ribs (not shown.) The lid 22 may be freely removable or it may be a conventional one-way locking lid such that once the lid 22 is attached to the container 10 it cannot be removed without evidence of the lid being tampered with.

The lid 22 and container 10 may be provided with a lock that does not allow the lid 22 to be removed without creating a visual indication of the fact that it has been removed, tampered with or it may cause damage to the container 10. The lid 22 may be constructed from a translucent or transparent material so the contents of the container 10 can be viewed without opening the lid 22.

Turning to FIG. 3, in a first embodiment the side wall 13 is covered with an absorbent material 25. When released by contact with liquid, the material 25 absorbs and then retains large volumes of liquids, preferably aqueous solutions including dilute alkalis, dilute acids and body fluids. An example of material 25 is sodium polyacrylate having the formula $(C_3H_3O_2N_a)_n$. The material is available under the trademark WATER LOCK J-550 from Grain Processing Corporation.

In one embodiment, the material 25 is bonded to the side wall 13 by a conventional adhesive(s) or the like.

Figure 4:
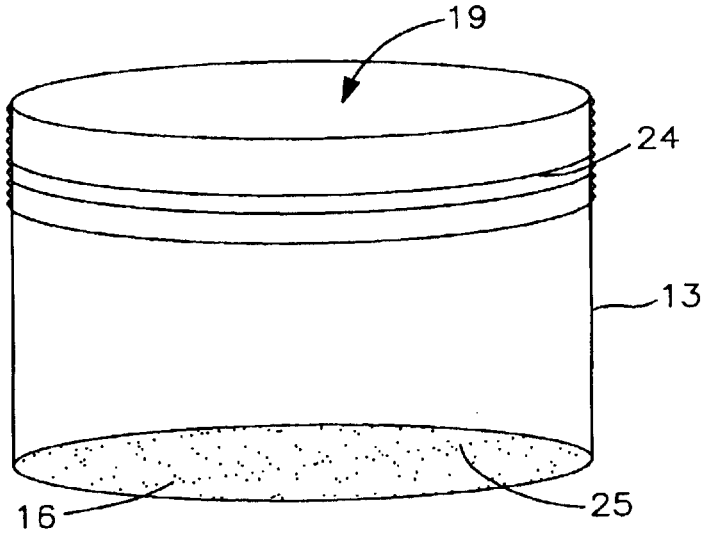
FIG. 4 is a perspective view of a first alternate embodiment of the present invention; and, FIG. 5 is a perspective view of a second alternate embodiment.

In FIG. 4, an alternate embodiment of the invention is shown where the absorbent material 25 is disposed on the bottom wall 16. As an additional alternative, the absorbent material 25 may be disposed on both the side wall 13 and the bottom wall 16.

Figure 5:
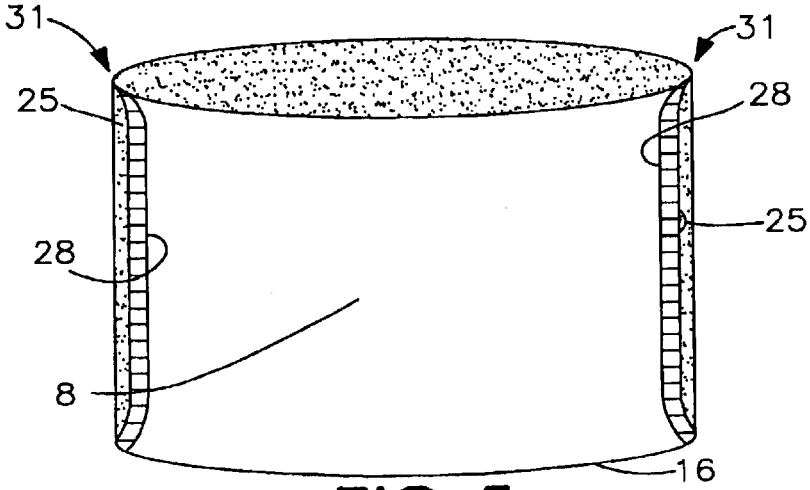

In another alternate embodiment shown in FIG. 5, the container 10 has an additional layer 28 of a water permeable material. Layer 28 is any conventional water permeable material, such as starch paper, polyvinyl acetate, water-soluble synthetic polymer films and water-soluble natural polymers. Examples of water permeable synthetic polymer films include partially saponified polyvinyl alcohol, polyethers, such as polyethylene oxide and the like, polyvinylpyrolidone, ethylenically unsaturated acids, such as acrylic acid, methacrylic acid, maleic acid, and polymers formed from the salts thereof.

Examples of water permeable semisynthetic polymer films include cellulose derivatives, such as carboxymethyl cellulose, hydroxyethyl cellulose, hydroxypropyl cellulose, and starch derivative such as cyclodextrin. As for the water soluble natural polymers, those include carrageena, starch, gelatin, and chitin.

The layer 28 attaches to predetermined portions of the side wall 13. The absorbent material 25 is contained between the side wall 13 and the layer 28.

In operation, the layer 28 dissolves when a liquid material contacts it or allows the liquid to penetrate through the layer 28. The liquid then contacts the absorbent material 25 which absorbs and then retains the liquid as described above. After the liquid is retained, the liquid can be extracted from the material 25 through a process that is described in another U.S. patent application that is licensed to the assignee of this application.

Accordingly, in some instances it may be desirable to have an additional layer 28 cover the absorbent material 25 until a liquid material is deposited into the container 10. It is desired that the deposit be directly inserted into the container 10. For example, if a pregnancy test is to be conducted, the user can urinate directly into the container 10. The bodily fluid contacts the absorbent material which converts the bodily fluid into a "gelatinous" state. The bodily fluid should not be released from the "gelatinous" state until the predetermined receiver of the gelatinous material extracts the bodily fluid from that gelatinous state.

In connection with this option there may be a disposable funnel or the like that could be used to direct the flow into the container 10. Once the liquid enters the container 10 and makes contact with the absorbent material 25, the liquid is absorbed and retained, in some instances immobilized, for shipping. The combined urine and absorbent material forms a gelled, gelatinous or gel-like substance that retains the liquid in an immobilized state. With the liquid retained, the material handling becomes much simpler and the problems associated with shipping liquids in vials, i.e., spilling, leaking, or the like are eliminated.

In another embodiment, the bodily fluid could be blood that is extracted from the body through a syringe. The extractor of the blood then deposits the blood from the syringe directly into the container 10. The blood, like the urine, is formed into a gelatinous state.

In another embodiment, the liquid can be water from a contaminated body of water, like the Hudson River. The user could scoop some of the contaminated water directly into the container 10 or indirectly through a second container that deposits the liquid into the container 10. In any case, the liquid is formed into a gelatinous state for further investigation.

As an option and in order to avoid the possibility of contamination, the container 10 may be constructed of a size and shape that is suitable for specific purposes. The container 10 need not have a fixed bottom wall 16, as shown in FIG. 1. Instead, the bottom wall 16 could be a seal of the sidewalls as shown in U.S. Pat. No. 5,984,087.

Once the liquid is placed in the container 10, the lid 22 is attached to the top of the container 10 by screwing or snapping it onto the end of the side wall 13 of the container 10. As discussed above, the lid 22 may be a standard removable type with a set of threads capable of engaging with threads disposed on the container 10. As an alternative, the container 10 can also be provided with a locking lid that will provide a visual indication if the lid is tampered with before it is received at its predetermined destination. Another alternative is to have a locking lid of the type where it cannot be removed without a special tool. If the lid 22 is removed without the tool, damage to the container 10 will occur and it will be obvious that the container 10 has been tampered with.

Once the container 10 is received at its destination, the liquid material, like urine, blood or water, can be separated from the gelatinous form through an osmosis process without any adverse ingredients being incorporated in the formerly gelled urine.

Accordingly, the present invention provides a container for shipping a liquid material and also provides a method for shipping urine, or other medium, specimens from a remote location for testing such as for pregnancy tests and the like.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A container with a directly deposited liquid medical specimen retained therein for shipping, comprising:

at least one sidewall having an inner surface defining the outer side boundary of a cavity and an outer surface designed to receive a lid Which defines the top boundary of the cavity;

a bottom wall connected to the at least one side wall and defining the bottom boundary of the cavity;

an absorbent material disposed on at least the sidewall or the bottom wall of the container;

a liquid medical specimen absorbed and retained in said absorbent material; and said container being free of other containers containing or adapted to contain said liquid specimen.

2. The container of claim 1, wherein the absorbent material is disposed on the inner surface of the at least one sidewall.

3. The container of claim 1, wherein the absorbent material is disposed on the bottom wall.

4. The container of claim 1, wherein the absorbent material is disposed on the inner surface of the sidewall and on the bottom wall.

5. The container of claim 1, further comprising a lid that is locked to the container so that it cannot be removed without providing a visual indication that the lid has been tampered with.

6. The container of claim 5, wherein the lid cannot be removed without damaging the container.

7. The container of claim 1, further comprising a lid removably secured to said container.

8. The container of claim 1, further comprising a lid that is translucent.

9. The container of claim 1, further comprising a lid that is transparent.

10. A container and liquid specimen capture and transport kit, comprising:

at least one sidewall having an outer surface that is designed to receive a lid which defines a top boundary of a cavity and an inner surface that defines a side boundary of the cavity, the cavity being initially completely empty for receiving liquid therein, the inner surface having an absorbent material disposed thereon, the absorbent material is designed to absorb and retain a liquid material to be stored in the container;

a bottom wall connected to the at least one sidewall which defines the bottom boundary of the cavity;

a lid adapted to attach to a portion of the sidewall where an opening to the cavity is defined, the lid having a lock such that once the lid is attached it cannot be removed without providing a visual indication thereof; and funnel means for directing flow of a liquid specimen into said container for absorption and retention by said absorbent material.

11. The container of claim 10, wherein the lid is translucent.

12. The container of claim 10, wherein the lid is transparent.

13. A method for shipping a liquid material, comprising:

providing a container having at least one sidewall having an inner surface and an outer surface, a bottom wall connected to the at least one side wall, a lid attachable to a portion of sidewall where an opening is defined, and an absorbent material disposed inside the container, the absorbent material being of a type that absorbs and retains the liquid material in the container until a predetermined time;

directly depositing the liquid material into the container which is initially empty so that the absorbent material absorbs and retains the liquid as it enters the container; and, attaching the lid to the portion of the sidewall adjacent to the opening.

14. The method of claim 13, wherein the liquid material is a bodily fluid.

15. The method of claim 14, wherein the bodily fluid combines with the absorbent material to form a gelastic substance.

16. The method of claim 15, wherein the bodily fluid can be removed from the gelastic substance through osmosis.

17. The method of claim 13, wherein the lid has a lock so that the lid cannot be removed from the container without providing a visual indication thereof.

18. The method of claim 13, wherein the absorbent material is disposed on the inner surface of the at least one sidewall.

19. The method of claim 13, wherein the absorbent material is disposed on the bottom wall.

20. The method of claim 13, wherein the absorbent material is disposed on the inner surface of the sidewall and on the bottom wall.

21. The method of claim 13, wherein the container further comprises a layer of a water permeable film superimposed and bonded to predetermined portions of the inner surface of the at least one side wall, and wherein the liquid material permeates through the water permeable film when the liquid material contacts the film.

22. The method of claim 21, wherein the absorbent material is disposed between the film and the inner surface of the sidewall.

* * * * *